US005261176A

United States Patent [19]

David et al.

[11] Patent Number: 5,261,176

[45] Date of Patent: Nov. 16, 1993

[54] BEVERAGE IDENTIFICATION TAGS FOR CUP HANDLES

[76] Inventors: George David; Rose H. David, both of 1822 Andoa La., Mt. Prospect, Ill. 60056

[21] Appl. No.: 823,175

[22] Filed: Jan. 21, 1992

[51] Int. Cl.[5] ..... G09F 3/00

[52] U.S. Cl. ..... 40/324; 40/666; 283/74; 283/114

[58] Field of Search ..... 40/306, 310, 316, 324, 40/658, 666; 283/72, 74, 56, 114

[56] References Cited

U.S. PATENT DOCUMENTS 2,835,057 5/1958 Mathews ..... 40/324
2,879,613 3/1959 De Mario ..... 40/324
4,180,284 12/1979 Ashley ..... 283/74 X

FOREIGN PATENT DOCUMENTS 2655958 6/1978 Fed. Rep. of Germany ..... 40/316
11352 of 1906 United Kingdom ..... 40/324

*Primary Examiner*—Kenneth J. Dorner
*Assistant Examiner*—Brian K. Green
*Attorney, Agent, or Firm*—Charles F. Lind

[57] ABSTRACT

The disclosed tag system is comprised of a plurality of split ring tags, each defining a substantially enclosed opening larger than the cross section of the handle of a container, such as a coffee cup intended for holding a customer's beverage. Each tag has sufficient stiffness to normally retain its opposed end edges aligned, maintaining a gap therebetween smaller than the handle cross section. Each tag is resilient and has a shape memory, to allow manual tag flexing so as to allow any specific tag to be fitted onto or remove it from the container handle. The system provides that the tags are visually distinct, allowing a coded identification between specific tags and beverages and the visual identification of the beverage in or intended for a tagged container corresponding to the tag thereon.

2 Claims, 1 Drawing Sheet

BEVERAGE IDENTIFICATION TAGS FOR CUP HANDLES

BACKGROUND OF THE INVENTION

Many restaurants, cafeterias, or other food eating establishments provide for free refills of your beverage, such as coffee or tea. Because these beverages cannot be distinguished visually, the server must verbally ask the customer what the beverage for refill is or was. This interruption can be a source of irritation to the customer. Moreover, some customers could find it difficult to verbally communicate the needed beverage information, such as a handicapped person or a foreigner unable to speak the language.

SUMMARY OF THE INVENTION

This invention provides an easily implemented system for allowing a positive visual identification of a beverage in a handled container, such as a drinking cup, suited to convey refill information to the server without requiring any verbal communication from the customer.

One object of the present invention is to provide a family of distinguishing tags that can be easily fixed to and removed from a drinking cup handle, and coded to allow visual communication to the server of the corresponding beverage in the cup, to allow any server to make correct refills.

A more detailed object of this invention is to provide the family of distinguishing tags by having them of different shapes and/or colors and/or marked with different indicia thereon, like tags being suitably coded by a server to correspond to a specific beverage, and further of having the tags constructed to be easily locked onto or removed from the cup handle by the customer or server to establish a coded visual communication the server can use in identifying the beverage intended for the cup.

To achieve these and other objects, the tag system is comprised of a family of separate split ring tags each defining a substantially enclosed opening larger than the cross section of the container handle, where each tag has sufficient stiffness to normally retain its end edges adjacent to one another defining a gap therebetween smaller than the cross section of the container handle. Each tag is resilient and has a shape memory, to allow manual flexing and opening of the tag so as to fit any specific tag of the family onto or remove it from the container handle. The system provides that the tags are visually distinct, allowing the coded identification between specific tags and specific selected beverages, for providing the visual identification of a specific beverage in or intended for a tagged container corresponding to the specific tag thereon.

BRIEF DESCRIPTION OF THE DRAWINGS

Further objects, advantages and features of the present invention will appear from the following disclosure and description, including as a part thereof the accompanying drawing, in which.

DETAILED DESCRIPTION OF ILLUSTRATED EMBODIMENTS OF THE INVENTION

Figure 1:
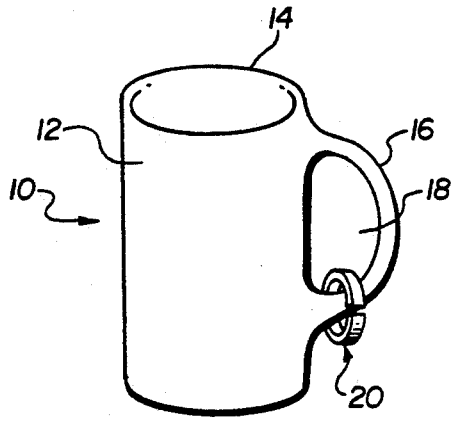
FIG. 1 is a perspective view of a typical drinking cup, with a first embodiment of the identification tag mounted in place on the cup handle.
Figure 2:
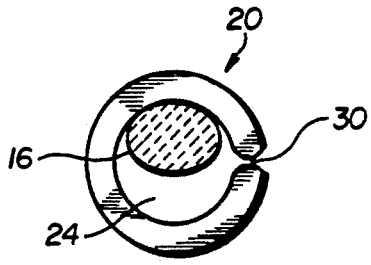
FIG. 2 is a sectional view of the cup handle of FIG. 1, illustrating the identification tag thereon.
Figure 4:
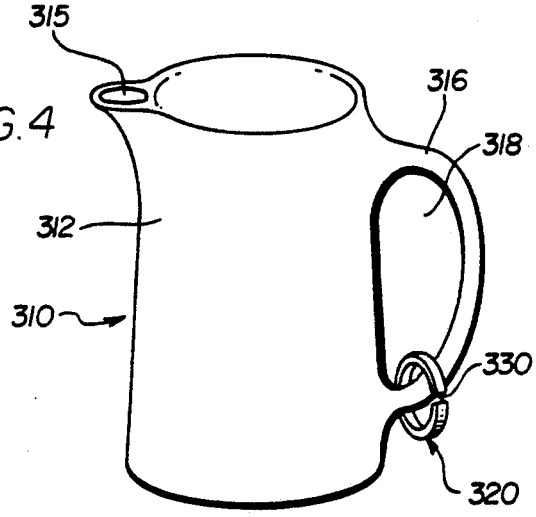
FIG. 4 is a perspective view of a typical pitcher, with the identification tag of FIGS. 1–3 mounted in place on the handle thereof.
Figure 3:
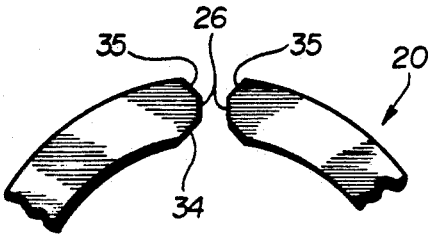
FIG. 3 is an enlarged frontal elevation of the ends of the identification tag of FIGS. 1 and 2.
Figure 5:
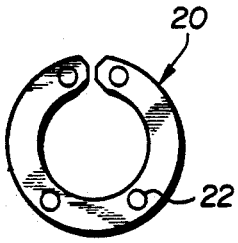
FIG. 5 is a frontal elevation of the identification tag of FIGS. 1 and 2 illustrated apart from the cup.
Figure 6:
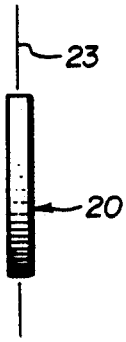
FIGS. 6 and 7 are side elevational views of the identification tag of FIG. 5, FIG. 6 illustrating it in its normal condition and FIG. 7 illustrating it in its flexed condition to allow it to be easily put on or taken from the handle.

FIG. 1 shows a cup or mug type container 10 having a continuous side wall 12 terminating at an upper drinking rim 14, and a handle 16 formed off of the side wall defining an opening 18 sized to receive one or more fingers of its user, for holding the cup. A pitcher type container 310 is illustrated in FIG. 4, with a side wall 312 defining a pouring spout 315, and a handle 316 formed off of the side wall defining opening 318 sized to receive possibly the entire user's hand, for holding the pitcher.

Depending on the style and size of the container 10 or 310, the handle 16 or 316 typically will have a substantially rounded cross-section between approximately $\frac{1}{4}$ and $\frac{3}{4}$ inch across.

The invention provides for the generation of a family of distinct tags, usable in public or commercial food eating establishments, adapted to be mounted or hung in place on the container handle by the customer or server for identifying the beverage contained or to be contained in the container.

Figure 8:
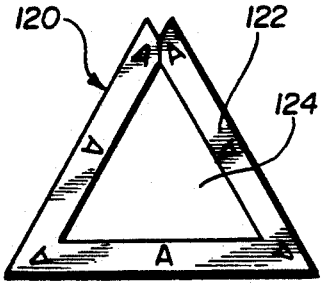
FIG. 8 is a frontal elevation of a second embodiment of identification tag.
Figure 9:
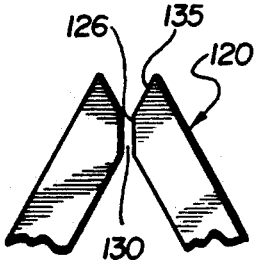
FIG. 9 is an enlarged frontal elevation of the ends of the identification tag of FIG. 8.
Figure 10:
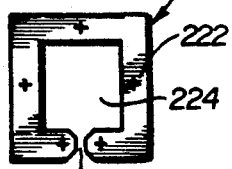
FIGS. 10 and 11 are views respectively similar to FIGS. 8 and 9, but of yet a third embodiment of the identification tag.
Figure 11:
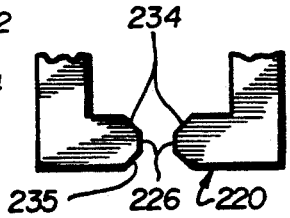

The tags of a family are visually distinguishable or distinct, and the illustrated tags 20 (or 320), 120 and 220 differ from one another in shape. Thus, tag 20 (or 320) in FIGS. 1–7 is generally circular, tag 120 in FIGS. 8 and 9 is generally triangular, and tag 220 in FIGS. 10 and 11 is generally square.

Other ways of distinguishing the tags could be used, including having different indicia (such as numbers, letters or designs) imprinted on the exposed tag faces, or of making the tags of different colors (not shown). Different indicia is illustrated as number "0" at 22, as letter "A" at 122, and as sign "+" at 222 in FIGS. 5, 8 and 10 respectively.

In practice, one family of distinguishing tags could be defined by using different tag shapes only, such as a three member family using the three shapes illustrated. Other tag families could have the same shape, such as all being circular, and different tag colors might be used to define one family and different tag indicia might be used to define another family. Moreover, the distinguishing family characteristics of different tag shapes and/or tag colors and/or tag indicia could be combined, and coded by the server for communicating information identifying an even broader selection of beverages. Of importance, once a coded communication system of tags and associated beverages were established, a number of each different tag would typically be provided, virtually identical to one another, allowing the system to be used universally or repeatedly.

Each of the tags 20 (and 120, 220 and 320, although not illustrated) normally lies substantially along a flat plane (23 see FIG. 6), and has an elongated narrow body curved or extended over substantially a full 360 degrees and defining a substantially enclosed opening 24 (124 and 224) larger than the cross section of the container handle, and having end edges 26 (126 and 226) that lie proximate one another in the form of a split ring.

The tag body is formed of a low cost solid plastic or from a low cost degradable paper, and thus has both resilience and shape memory. The elongated tag body has sufficient strength and stiffness between its ends for normally retaining the end edges aligned opposite one another, with a gap 30 (and 130, 230 and 330) therebetween smaller than the cross section of the handle 16 (or 316).

Figure 7:
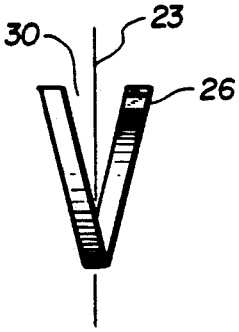

The tag body however can be manually flexed to shift the end edges 26 (and 126 and 226) laterally out of the plane 23 (as illustrated in FIG. 7) to increase the size of the gap 30 (and 130, 230 and 330) to something larger than the cross section of the container handle 16 (or 316), to allow the tag to be fitted onto or pulled off of the handle.

When the tag ends have been positioned past the container handle 16 (or 316) and the container handle lies within the tag opening 24 (and 124 and 224), releasing the tag allows it to return to its normal generally planar configuration and become trapped on the handle; and the tag would remain so positioned unless intentionally removed or pulled off.

The tag end edges 26, 126 and 226 are formed to lie generally parallel to one another, aligned radially or outwardly of the defined tag opening. Where the tag end edges are formed along the mid-section of a slightly curved or generally straight section of the elongated tag body, tapered edges 34, 35 and 234, 235 (see FIGS. 3 and 10) are formed inside and outside respectively of the end edges. This allows the user to align the tag gap at the handle easily, when the tag is to be fitted onto or pulled off of the handle. Where the tag ends 126 are formed at corners between generally straight sections of the elongated tag body, only outside tapered edges 135 need be formed (see FIG. 9).

The inventive tag identification system would be practiced in either of two typical modes of use. In situations where the server obtained an initial verbal order from the customer of a selected beverage and thereafter brought the filled beverage cup to the customer, the server generally would place the tag on the cup. Alternatively, in situations where an empty cup were in place at the customer's table, a supply of the tags and information describing the corresponding tag-beverage code would also be provided, whereupon the customer would or could put the proper tag on the handle for the selected beverage and the server thereupon could fill and refill the cup via this communicated visual signal.

The tag would be removed from the container handle after use, when the container is to be washed. A plastic tag would be more durable and could be reused; but it may not be preferred as it could clog dishwasher drains should it inadvertently be left on the container handle after use. A paper tag would be inexpensive and disposable and might be preferred, as even if it inadvertently were left on the handle after use it should not cause drain clogging problems when compared to the already substantial acceptable use of paper napkins in public or commercial food eating establishments.

A circular or elliptical tag shape, or a five or six sided polygon, might be preferred as each generally defines a large enclosed opening compared to the overall exterior size of the tag.

Selected colors of particular interest would be brown and orange, corresponding to the pot colors already used for regular and decaffeinated coffee. Green might be used to correspond to tea.

While specific embodiments of the invention have been illustrated, variations may be made therefrom without departing from the inventive concept. Accordingly, the invention is to be limited only by the following claims.

What is claimed as our invention is:

1. A tag system comprised of:

groups of separate tags, all tags within any group being visually substantially identical to one another, and the tags of each group being visually distinct from the tags of other groups;

each of the tags having an elongated narrow body shaped substantially uniformly over substantially a full 360 degrees to separate end edges defining a substantially enclosed tag opening, and each of the tags when unflexed lying in a plane and presenting its end edges aligned opposite but closely adjacent one another and defining a gap therebetween;

each said tag body being of a degradable paper thin in the direction axially of the tag opening, and having sufficient stiffness and shape memory to have the tag remain in and return generally to its flat unflexed configuration and having sufficient resiliency to allow manual flexing in the direction laterally out of the plane and axially of the tag opening to vary the gap;

the visually distinct tag groups respectively having different tag shapes, including being generally circular, triangular and square;

the tag system being suited for visual coded identification by specific tag groups of specific beverages held or to be held in containers each having an closed loop handle defining a finger opening and formed of a gripping cross-section, and thereby each said tag opening being larger than the handle cross section and the gap being larger than the handle cross section when the tag is flexed allowing the tag to be fitted onto or removed from the container handle and the gap being smaller than the handle cross section when the tag is unflexed for trapping the tag on the container handle; and each of the tags being free from any connection to any bag of a type normally held in the container for forming the beverage, suited to remain trapped on the container handle when drinking from the container.

2. A tag identification system according to claim 1, further including the visually distinct tag groups respectively having different tag colors, including brown, orange and green.

* * * * *